US007096628B2

(12) United States Patent
Millward

(10) Patent No.: US 7,096,628 B2
(45) Date of Patent: Aug. 29, 2006

(54) COLLAPSIBLE VEHICLE STORAGE STRUCTURE

(76) Inventor: Stanley Millward, Herbert Taylor House, Graingers Lane, Cradley Heath, Warley, West Midlands (GB) B64 7BS ( * ) Notice: Subject to any disclaimer, the term of this patent is extended or adjusted under 35 U.S.C. 154(b) by 136 days.

(21) Appl. No.: 10/513,342

(22) PCT Filed: Mar. 3, 2003

(86) PCT No.: PCT/GB03/00887

§ 371 (c)(1),
(2), (4) Date: Nov. 3, 2004

(87) PCT Pub. No.: WO03/076743

PCT Pub. Date: Sep. 18, 2003

(65) Prior Publication Data

US 2006/0043760 A1 Mar. 2, 2006

(30) Foreign Application Priority Data

Mar. 8, 2002 (GB) ..... 0205488.0

(51) Int. Cl.
*E04B 1/34* (2006.01)

(52) U.S. Cl. ..... 52/143; 296/136.12; 296/136.02; 52/67

(58) Field of Classification Search ..... 296/136.02, 296/136.01, 100.1, 100.09; 52/143
See application file for complete search history.

(56) References Cited

U.S. PATENT DOCUMENTS 3,465,765 A * 9/1969 Dietz ..... 52/67
4,288,949 A * 9/1981 Latimer ..... 52/67
4,306,390 A * 12/1981 Brown ..... 52/67
5,507,121 A * 4/1996 Taylor ..... 52/66
5,522,409 A * 6/1996 May ..... 135/88.05
5,655,559 A * 8/1997 Zembik et al. ..... 135/132
5,740,826 A * 4/1998 Nevin et al. ..... 135/88.06
5,746,237 A * 5/1998 Arnic ..... 52/66
D421,131 S * 2/2000 Lynch ..... D25/34
6,092,856 A * 7/2000 Ladensack ..... 296/136.12
6,349,732 B1 * 2/2002 Cooper ..... 52/66
7,013,904 B1 * 3/2006 Kofler ..... 296/136.12
2004/0251715 A1 * 12/2004 Tahara ..... 296/155

FOREIGN PATENT DOCUMENTS

| | | |
|---|---|---|
| EP | 0 561 576 A1 | 9/1993 |
| GB | 233109 | 5/1925 |
| JP | 10115111 | 5/1998 |

* cited by examiner

*Primary Examiner*—Kiran B. Patel
(74) *Attorney, Agent, or Firm*—Nixon & Vanderhye P.C.

(57) ABSTRACT

A vehicle cover (10) has first and second cover members (12, 14) of which one pivots relative to the other about a pivot (A) to move between open and closed positions of the cover. The cover (10) includes a base on which one of the members is mounted and the arrangement is such that after one of the cover members is pivoted relative to the other, the two cover members (12, 14) are moveable as one relative to the base to enable full access to the vehicle.

13 Claims, 6 Drawing Sheets

COLLAPSIBLE VEHICLE STORAGE STRUCTURE

This application is the US national phase of international application PCT/GB03/00887 filed 3 Mar. 2003 which designated the U.S. and claims benefit of GB 0205488.0, dated 8 Mar. 2002, the entire content of which is hereby incorporated by reference.

The present invention relates to a cover or enclosure for a motor vehicle and particularly, but not exclusively, to a cover for a small automobile.

It is known to provide portable or semi-portable covers, enclosures or shelters to provide protection for vehicles such as cars or motorcycles from adverse weather conditions and to reduce the occurrence of vandalism or attempted theft of the vehicle.

Such enclosures are primarily intended for use in housing relatively narrow vehicles such as motorbikes and, specifically, vehicles which do not possess side-opening doors. Provided that the enclosure is sufficiently proportioned, it is possible to house a larger vehicle, such as a conventional automobile, in the enclosure. However, the side-opening doors of the vehicle can be prevented from fully opening by the side walls of the enclosure.

One solution to this problem which has been proposed is to proportion the enclosure such that it is sufficiently wide to permit the doors of the vehicle to be opened within the enclosure. Another option is to manually push or pull the vehicle into and out of the enclosure but the latter solution is impractical for most purposes.

It is an aim of the present invention to provide an improved cover or enclosure for a vehicle which addresses one or more of the problems associated with existing covers.

According to one aspect the present invention there is provided a cover for a vehicle, the cover comprising first and second cover members, the second cover member being pivotable by pivot means relative to the first cover member between open and closed positions of the cover, in the open position of which one member lies inside the other member, and a base member on which the first cover member is mounted so that, after the second cover member is pivoted to the open position, the first and second cover members are reciprocally moveable as one relative to the base member to give full access to a vehicle within the cover.

Preferably, the base member is arranged to be fixed and provide guide means co-operating with the first member to permit said reciprocal movement by way of rolling action.

More preferably, the guide means is slidably engagable with a fixed part of the cover thereby to enable said first and second cover members to slide relative to said fixed part from said open position to the full access position.

Advantageously, the cover may comprise a plurality of rotatable wheels or the like.

The cover may further comprise means for automatically pivoting said second cover member from the closed position to the open position. Alternatively, or in addition, the cover may comprise means for automatically moving said first and second cover members to and from the full access position.

Advantageously, the cover includes means for controlling the pivoting movement of the members and, for example, biassing the members towards said one or other position or towards both positions from a neutral position.

Conveniently, the first and second cover members are of a generally rigid structure and define between them a substantially sealed enclosure when in the closed position.

The invention may also provide a cover as described above having an integral dehumidifier unit for extracting water vapour from within the storage enclosure.

The invention will now be described, by way of example only, with reference to the drawings in which.

Figure 1:
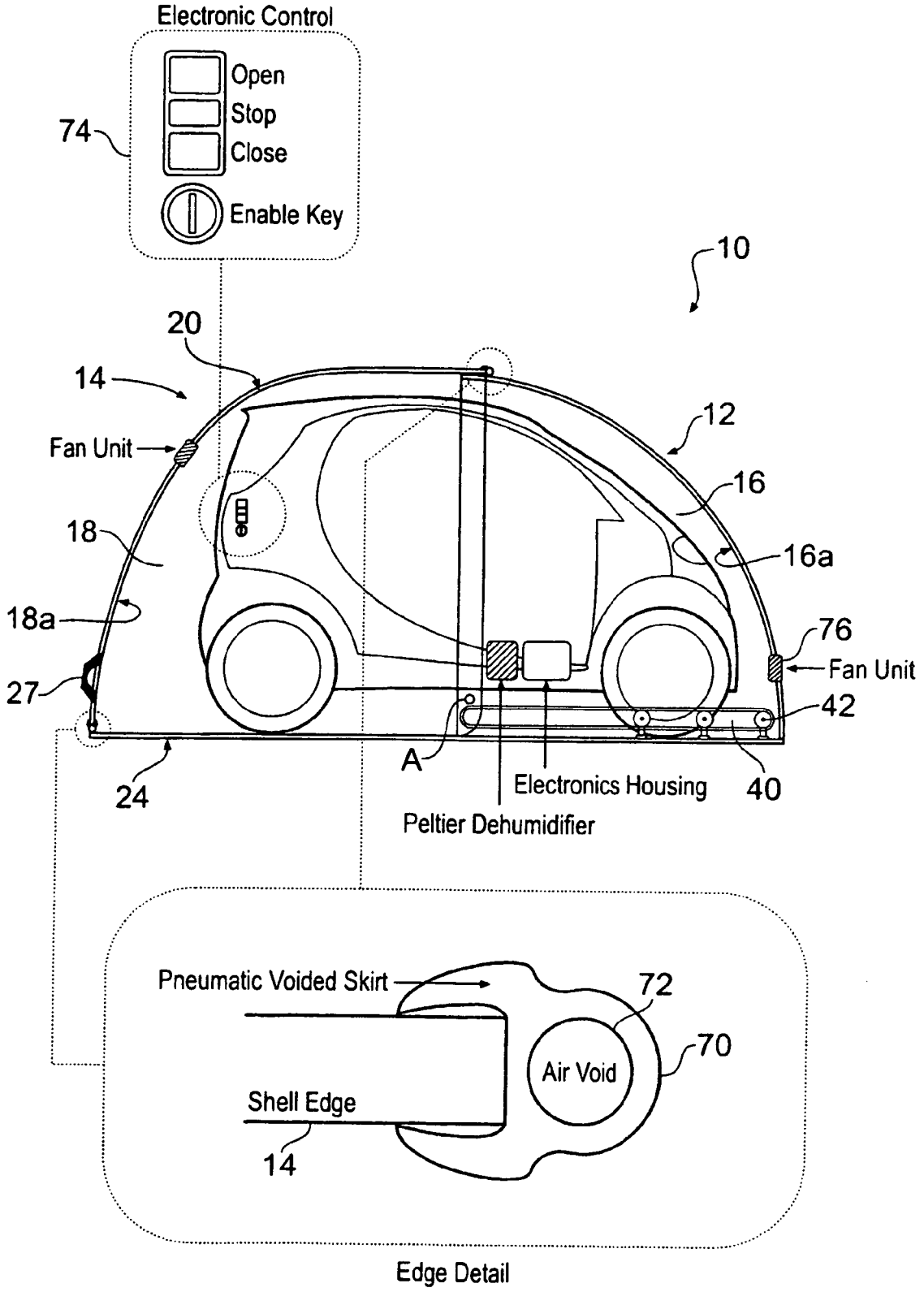
FIG. 1 illustrates a preferred form of cover in side elevation.

Referring to FIG. 1, a preferred form of cover according to the invention is shown generally at 10 and comprises first and second cover members 12, 14 each being generally of similar shape as described below.

Each of the first and second cover members 12, 14 comprises two spaced-apart substantially parallel, sector-shaped side walls 16, 18 which are interconnected by means of an arcuate top wall 20 joining the arcuate edges 16*a*, 18*a* of the side walls 16, 18.

The second cover member 14 is generally similar in shape to the first cover member 12 but has larger dimensions than the first cover member 12 for reasons described below. A handle 27 is provided on the top wall 20 near the edge thereof adjacent the open face 24 of the second cover member.

The first and second cover members 12, 14 are preferably constructed from an integral plastics or fibreglass moulding, from one or more sheet metal pressings, or from fabric or sheet plastics skin supported on a relatively rigid framework.

The first and second cover members 12, 14 are pivotally connected together at their side walls 16, 18 by means of pivots, enabling the second cover member to pivot or rotate relative to the first cover member about an axis of rotation A. The axis of rotation A defined by the pivots and extends laterally through the side walls 16, 18 of the first and second cover members 12, 14 at a point distanced from the apex or centre radius of each side wall. The pivots are provided by means of bolts or pins 30, best illustrated in FIG. 3.

It will be understood from the foregoing that the second cover member 14 is able to pivot or rotate relative to the first cover member 12 between a first, closed position (as shown in the upper drawing of FIG. 2) where the first and second cover members together define a storage area, enclosure or volume in which a vehicle, such as a small automobile, may be stored, and a second, open position (as shown in the centre drawing of FIG. 2) in which access to the storage area is permitted. It will further be understood that the axis of rotation A about which the second cover member 14 pivots is offset form the geometrical centre or centre of radius of the side walls of each cover member.

Figure 2:
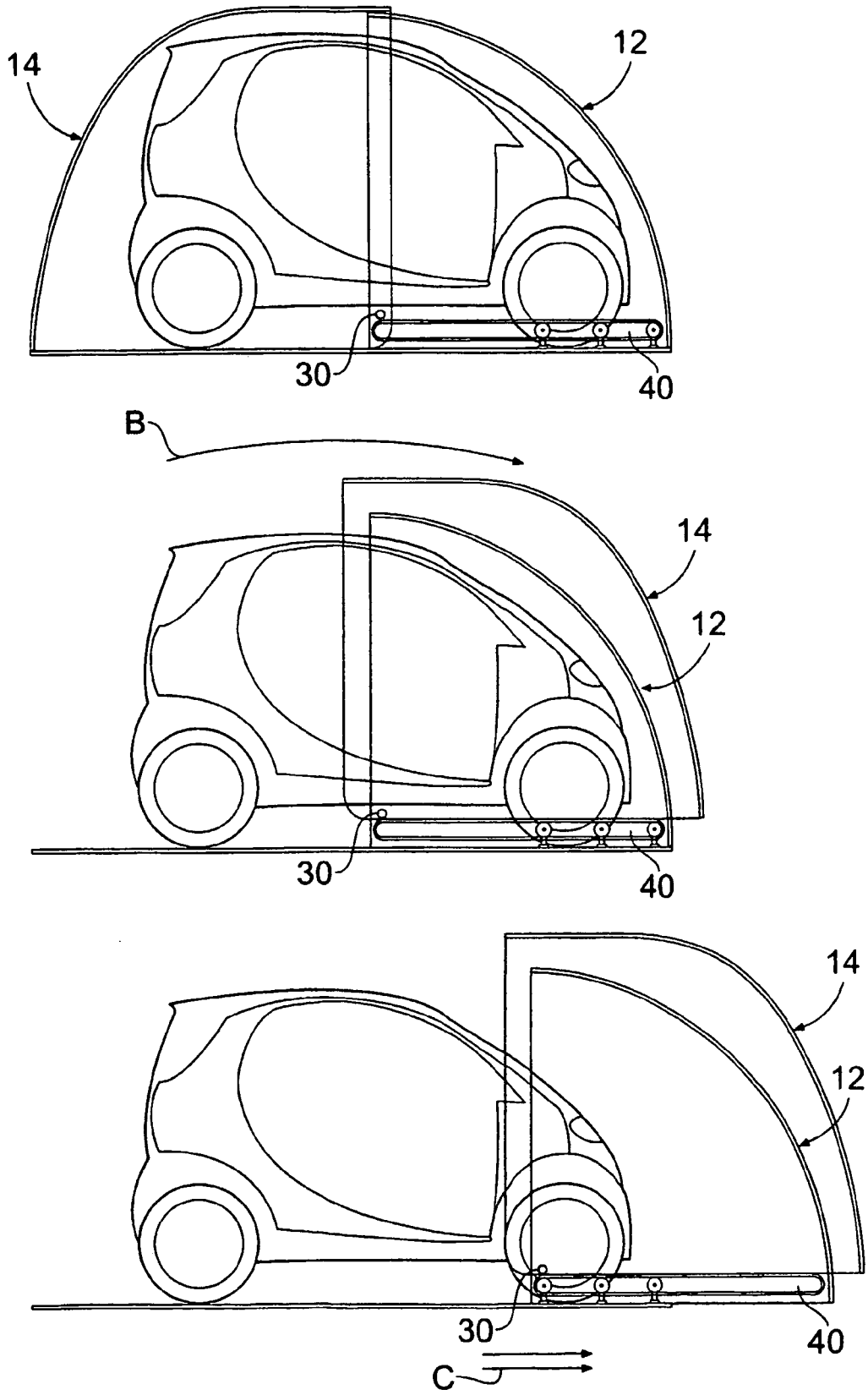
FIG. 2 is a side view of the cover of FIG. 1 in its closed, open and full access positions.

As shown in the upper drawing of FIG. 2, in the closed position, the first and second cover members 12, 14 are arranged with their front faces opposing and their bottom faces adjacent and generally parallel to the ground. The cover 10 in this position defines an enclosure or storage area in which a vehicle such as a small automobile may be stored.

As shown in the centre drawing of FIG. 2, the second cover member 14 is arranged to be pivoted about the pivots 30 in the direction of the arrow B such that it extends over the first cover member 12, the latter effectively being telescopically withdrawn into the second cover member 14. In the open position, the second cover member 14 has pivoted through approximately 90° relative to the first cover member 12 which is thus substantially contained within the second member 14 with the front face 22 of the first cover member and the bottom face 24 of the second cover member generally co-planar. An opening, defined by the bottom face of the second cover member 14 and the front face of the first cover member 12, is thus provided through which access to the storage area is permitted and by which a vehicle may be removed from, or placed within, the storage area. Owing to the offset location of the pivot point relative to the centre of radius of the first and second cover members, in the open position, the front face of the second cover member lies a short distance off the ground such that the second cover member is substantially wholly carried by the first cover member.

In the open position, as stated above, access to the storage area is permitted. However, as can be seen from the vehicle outline in the drawings, the side-opening doors of the vehicle are restricted from opening to any extent by the side walls 16, 18 of the first and second cover members. This problem is particularly acute where the cover has an internal width which is only slightly greater than the maximum width of the car, thereby to minimise the ground space taken up by the cover whilst still enabling the car to fit within the storage area.

Figure 3:
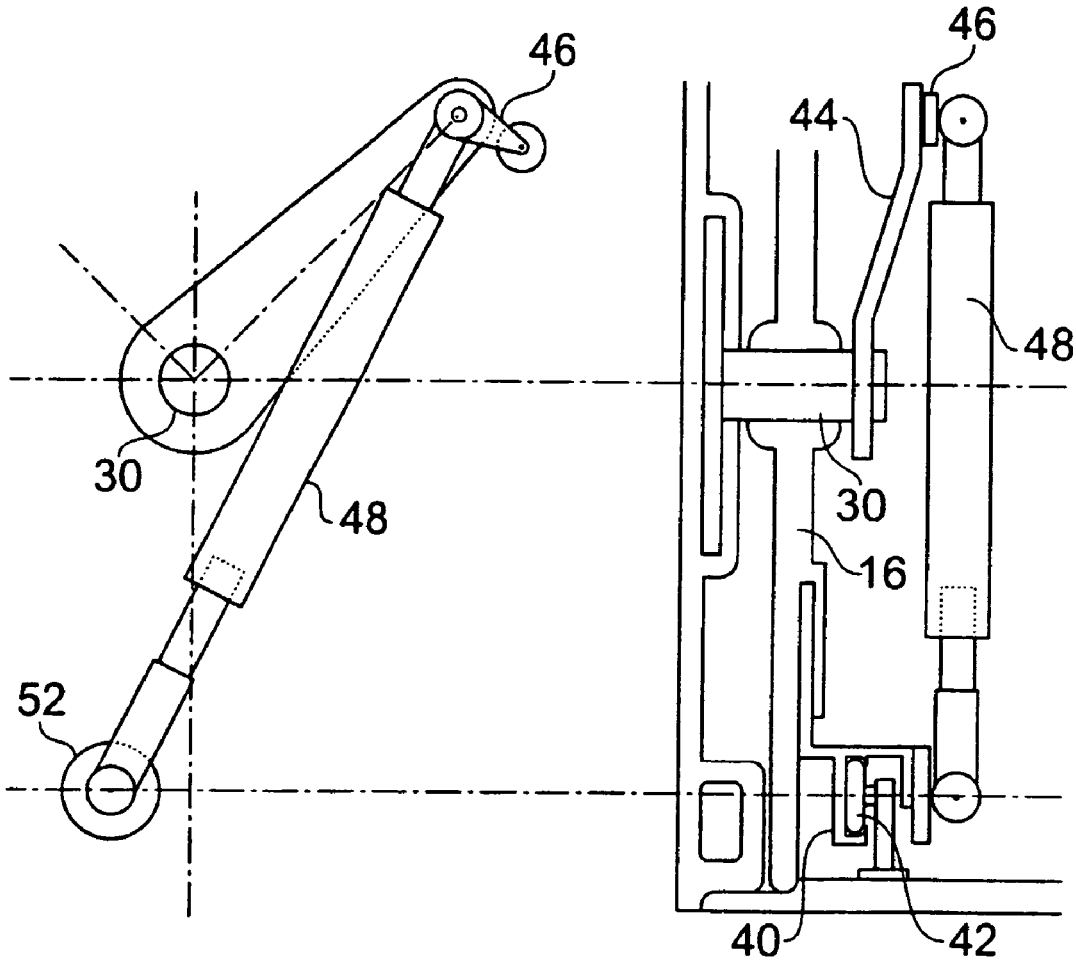
FIG. 3 illustrates a mechanism for controlling the opening and closing of the cover of FIG. 1.

In order to address this problem, the first cover member 12 is provided with guide means in the form of an elongate, generally horizontal track or runner 40 formed on the inside surface of each side wall 16, 18 thereof. The track 40, which is best shown in FIG. 3, extends substantially parallel to and adjacent the lower edge of the first cover member and is engagable with a plurality of rotatable wheels 42 which are carried on a guide fixed relative to the ground surface so as to be slidable therealong. This arrangement permits the first cover member to be translated, i.e. to move laterally without angular displacement, relative to both the ground surface and the vehicle within the storage area.

Thus, as shown in the lower drawing of FIG. 2, the first and second cover members 12, 14, the latter being carried by the former, are arranged to be slidable forwardly of the storage area, in the direction of arrow C, thereby to move the side walls thereof away from a position which hinders or prevents opening of the side doors of the vehicle. In this third position, referred to as the "full access" position, the side walls 16, 18 of the first and second cover members 12, 14 are positioned away from the doors of the vehicle which can thus be opened easily to enable the vehicle to be removed from within the storage enclosure.

In operation, therefore, if it is desired to remove a vehicle from within the cover 10, the second cover member 14 is manually rotated about the first cover member from the closed position to the open position. When the second cover member 14 is in the open position, i.e. it has rotated through substantially 90°, the first and second cover members 12, 14 are slid forwardly, relative to the vehicle, by means of the elongate track 40 disposed on the first cover member engaging with the wheels 42 on the guide so that the side walls 16, 18 of the first and second cover members 12, 14 are no longer obstructing the doors of the vehicle. The doors of the vehicle can thus be opened to enable the vehicle to be driven from within the storage area.

Referring to FIG. 3, this illustrates biassing means for neutrally biassing or counterbalancing the pivoting movement of the second cover member 14 about the first cover member 12. As illustrated, the second cover member 14 is pivotable about the first cover member 12 by means of a pin 30, which is rigidly connected to, and extends inwardly from, the inner surface of each side wall 18 of the second cover member 12 The pin 30 extends through an aperture in the corresponding side wall 16 of the first cover member 12, within which it is free to rotate. At its free end, the pin carries an armature or lever 44 which is fixed with respect to the pin 30 and hence with respect to the second cover member 14. Thus as the second cover member 14 rotates, so the lever 44 also rotates relative to the first cover member 12.

The free end of the lever 44 is rigidly connected to an end plate 46 of a gas strut arrangement comprising a gas strut 48. One end of gas strut 48 is pivotally connected to the end plate 46. As illustrated, the point at which the lever 44 is connected to the end plate 46 coincidental with the attachment of the lever 44 to the plate 46.

The other end of gas strut 48 is pivotally connected to the inner surface of the side wall 16 of the first cover member 12 at a point displaced to one side of a vertical line containing the pin 30.

Such displacement has regard to the centre of gravity of the cover during opening when the strut 48 provides greater assistance to opening and support for the cover than when the cover has moved towards the open position when support required is less.

Figure 4:
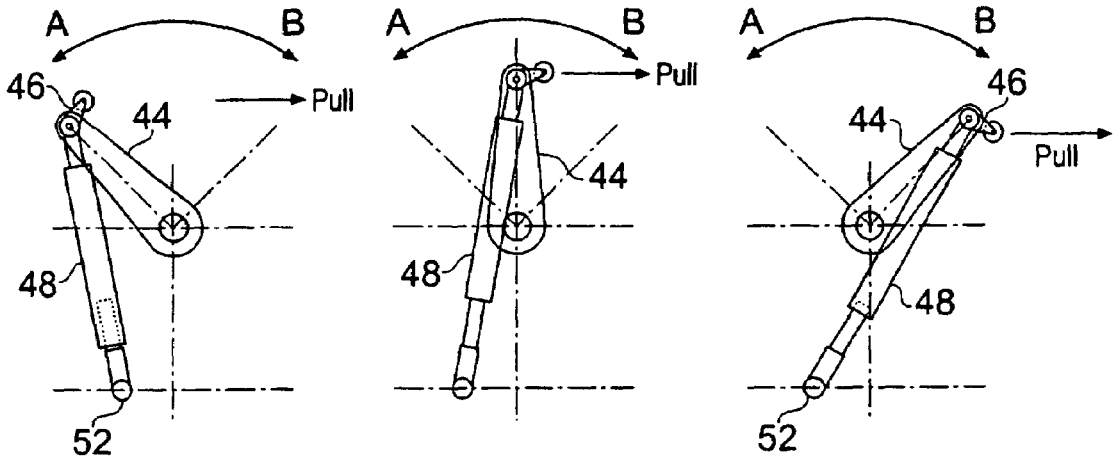
FIG. 4 illustrates operation of the mechanism of FIG. 3 between closed and open positions of the cover.

FIG. 4 illustrates the gas strut arrangement in operation. In the upper drawing, the cover 10 is in the closed position such that the lever 44 extends in a direction approximately 45° to the left of vertical. In this position, owing to the fixed nature of the connection between the lever 44 and the first end plate 46 compared to the pivotal connection between the second end plate 52 and the first cover member 12, the gas strut 48 is compressed.

As the second cover member 14 is rotated towards the open position, the lever 44 rotates in the direction of arrow B and the gas strut 48 is extended until, at a point midway between the closed and open positions, the lever 44 has moved through substantially 45° and is pointing substantially vertically and the gas strut 48 is extended.

As the second cover member 14 is rotated further towards the open position, the lever 44 rotates past the vertical and the distance between the plates 46 and pivot 52 starts to reduce such that the gas strut 48 begins to compress the reactive force generated by the gas strut 48 as it is compressed serves to counterbalance the weight of the second cover member 14 as its centre of gravity moves past the vertical.

At the fully open position of the second cover member 14, the lever 44 extends in a direction approximately 45° to the right of vertical and the gas strut 48 is compressed. During such movement the plate 46 moves from one side to the other of a line joining the pivot axis of pin 30 and the connection of strut 48 to plate 52.

A similar effect is achieved during closing of the cover with the gas strut 48 extending as the lever 44 rotates in the direction of arrow A towards the vertical and then compressing and generating a counterbalancing force as the lever moves past the vertical towards the closed position.

The damping effect of the gas strut ensures that a constant force, for example, provided by the user, is needed to pivot the second cover member 14 in each direction. In this case, if the second cover member 14 is released at any point during its pivoting motion, the force of the gas strut 48 retains the second member 14 at that position thus increasing operator safety. Moreover, since the gas strut 48 is relatively small, only a manual force is required to rotate the second cover member between open and close positions.

The gas strut arrangement described in relation to FIGS. 3–6 may be used in a cover with relatively pivotable components which are not intended to be moved as one when in the open position as described in relation to the present drawings. In this case access into the cover area is adequate without the extra translation movement. Such a cover may find application, for example, when motorcycles are to be covered.

Figure 5:
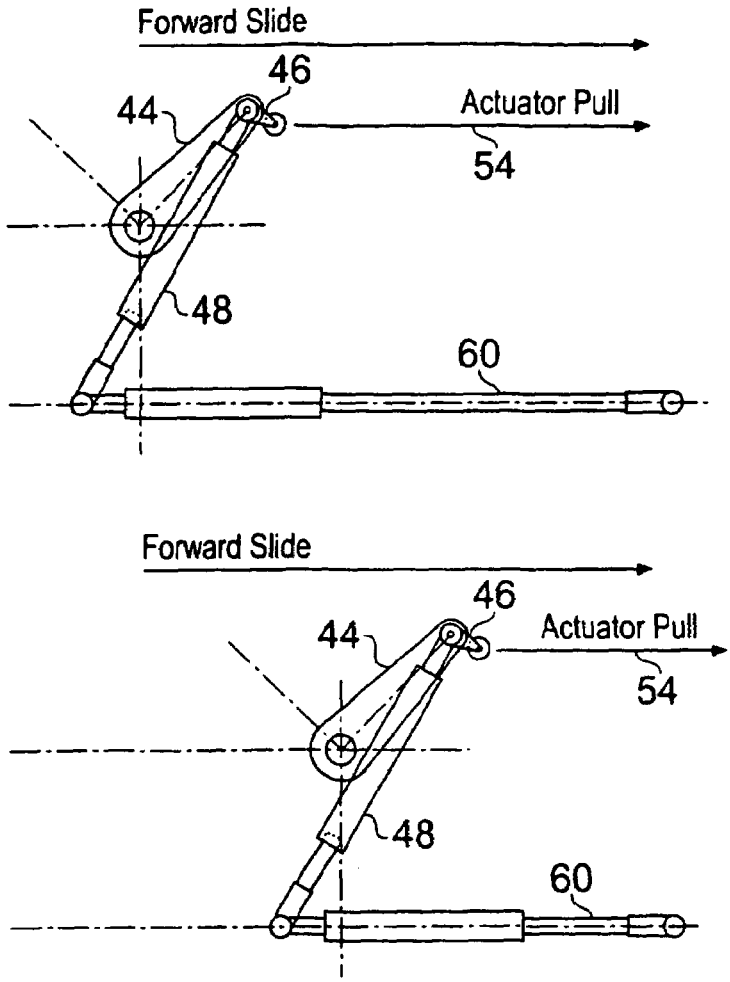
FIG. 5 illustrates a modification to the mechanism of FIG. 3 and its operation between open and full access positions of the cover.
Figure 6:
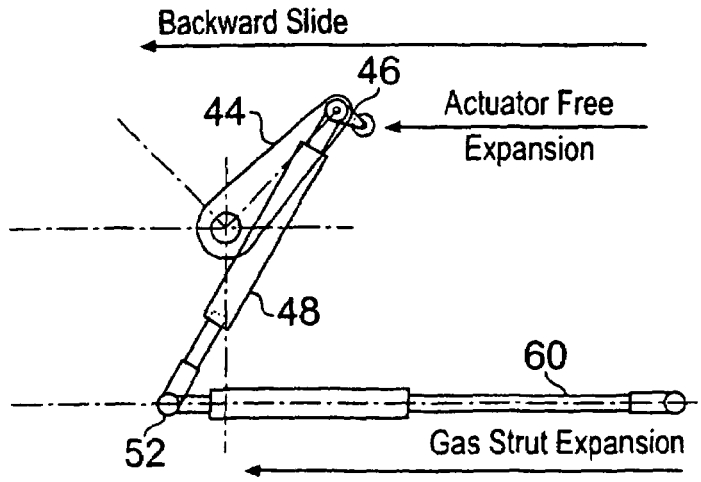
FIG. 6 illustrates operation of the mechanism of FIG. 5 between full access and open position of the cover.

In a modification to the above, however, the rotational movement of the second cover member 14 between closed and open positions may be achieved automatically by means of an electrical or hydraulic actuator, linear motor or the like as shown schematically in FIG. 5. In this embodiment, the free end of the actuator 54 is pivotally connected to the first end plate 46 and the other end connected to a support (not shown) which is fixed relative to the ground surface.

The actuator 54 is connected to a motor (not shown) which is arranged to drive the actuator in two directions, representing a closing stroke and an opening stroke. When the motor is activated, the pull or closing stroke of the actuator causes the lever 44 to rotate in the direction of arrow B such that the second cover member 14 pivots about the first cover member 12 from the closed to the open position. When the second cover member 14 has rotated to the open position, the lever is unable to be rotated further by the actuator 54 and so further force on the lever by the actuator causes the gas strut arrangement 48 to be drawn towards the support thereby causing the first and second cover members 12, 14 to be slid from the open position to the "full access" position.

To return the cover 10 to the closed position, the motor is driven in the opposite direction so that the push or opening stroke of the actuator 54 causes the first and second cover members 12, 14 to slide back from the "full access" position to the open position. When the cover members 12, 14 have returned to the open position and cannot be slid further, the further opening stroke of the actuator 54 causes the lever 44 to rotate in the direction of arrow A thereby causing the second cover member 14 to pivot from the open position to the closed position.

To ensure that the opening stroke of the actuator 54 does not cause the second cover member 14 to rotate in the direction of arrow B towards the closed position before the first and second cover members have slid from the full access position to the open position, a third gas strut 60 is provided having one end thereof pivotally connected to the second end plate 52 and the other end connected to a lower region of the support.

As the first cover member 12 is slid from the open position to the full access position by means of the actuator 54, the third gas strut 60 is compressed. During the opening stroke of the actuator 54, the expansion or opening stroke of the third gas strut 60 slides the first and second cover members 12, 14 from the full access position to the open position and the further opening stroke of the actuator 54 then causes the second cover member 14 to rotate from the open position to the closed position. This sequence will be maintained provided that the opening stroke of the third gas strut 60 is more rapid or forceful than that of the actuator 54.

The first cover member 12 may be located on a base plate carrying the rollers 42 which is itself anchored to the ground by means of, for example, rawl bolts or the like. The base plate may be made of steel, plastics or a composite material and may be shaped to correspond to the ground surface area covered by the cover 10 in the closed position.

It will be appreciated that various modifications or improvements may be made to the above described invention. For example, means could be provided to prevent the unwanted opening of the cover. For example, two aligned holes could be provided in the first and second cover members respectively through which a bolt or the like could be passed thereby to prevent relative pivotal movement of the cover members. Alternatively, the second cover member 14 could be releasably anchored to the ground by means of a latch or padlock arrangement.

In addition, in order to improve user safety, particularly where automatic operation of the cover is provided, a control system may be incorporated to control the pivoting movement of the second cover member about the first cover member. The control system includes a control unit having a microprocessor or the like for controlling the operation and direction of the motor which drives the actuator.

As illustrated in the inset of FIG. 1, the edges of the second cover member 14 may be provided with a flexible skirt 70 attached thereto having a tubular space or void 72 running along its length. A pressure sensitive switch is coupled to the skirt to monitor the pressure of the air within the void. Any changes in pressure within the void are detected by the pressure sensitive switch which then sends a detection signal to the microprocessor in the control unit.

Before any movement of the second cover member 14 is permitted, a solenoid-air pump mechanism connected to the void is pulsed so that an instantaneous pressure change occurs in the void. This pressure change is detected by the pressure sensitive switch and a signal is sent to the microprocessor. If no signal is sent to the microprocessor, the pressure sensitive switch is deemed to have failed and the control unit prevents movement of the second cover member. Likewise if, during movement of the second cover member a change in pressure within the void is detected by the pressure sensitive switch, such as may occur if the rubber skirts strikes an object, person or vehicle, the switch sends a signal to the microprocessor which immediately stops movement of the second cover member.

Control of the opening and closing of the cover may be achieved by a control panel 74 set on the cover itself or by means of a remote control on a key fob or the like. In either instance, it is preferable to have an enable button or the like together with open or closed buttons. In order to open the cover, the enable button must be pressed followed by the open button with a specified period of time. This ensures that an accidental pressing of the open button does not inadvertently open the cover. Provided the safety checks are met, as described above, the cover will then move. Similar considerations apply to the closing of the cover.

A stop button may also be provided which, when pressed, causes any movement of the cover to stop substantially instantaneously. In addition, where a locking mechanism is employed, such as a bolt described above, means may be provided to disable movement of the cover while the bolt is present.

The control system may permit the speed of opening or closing of the cover to be adjusted or specified. This may be achieved through the use of PWM techniques.

The security system, such as that found in a conventional automobile, may be provided as a deterrent to thieves or vandals. Motion detectors within the cover may be provided which trigger the alarm upon movement within the cover.

An interface may be provided on the cover to enable a user to specify operating parameters for the cover. In addition, means may be provided for monitoring the power levels of batteries or other power sources for the cover. In the event that the power from such sources falls below a predetermined level, the control system may disable certain functions of the cover which require high power levels.

A tape heater may be provided which extends along the edges of the cover members to prevent ice build up. A temperature sensor may monitor the ambient temperature and activate the tape heater when the temperature falls below a predetermined level.

Fans 76 may be provided in the cover for removing hazardous gasses from within the cover. A sensor may monitor the air within the cover and activate the fans if hazardous gasses are detected. Alternatively, the control system may activate the fans for a predetermined period of time after the cover has been closed. The control unit may also activate the fans when the temperature within the cover exceeds a predetermined level, thereby to cool the interior of the cover.

Advantageously, the internal surfaces of each of the first and second cover members may be treated with a close cellular foam or the like to provide sufficient thermal insulation for the cover. In addition, the surfaces can also be painted with anti-condensation paint to prevent condensation forming within the cover.

While movement of the cover members from the open position to the full access position is described above with respect to a translational or sliding movement, it may equally be possible to provide a further pivoting or rotational movement of the cover members to enter the full access position.

It will be appreciated that the cover may be used for storing items other than vehicles, such as garden equipment or the like.

Figure 7:
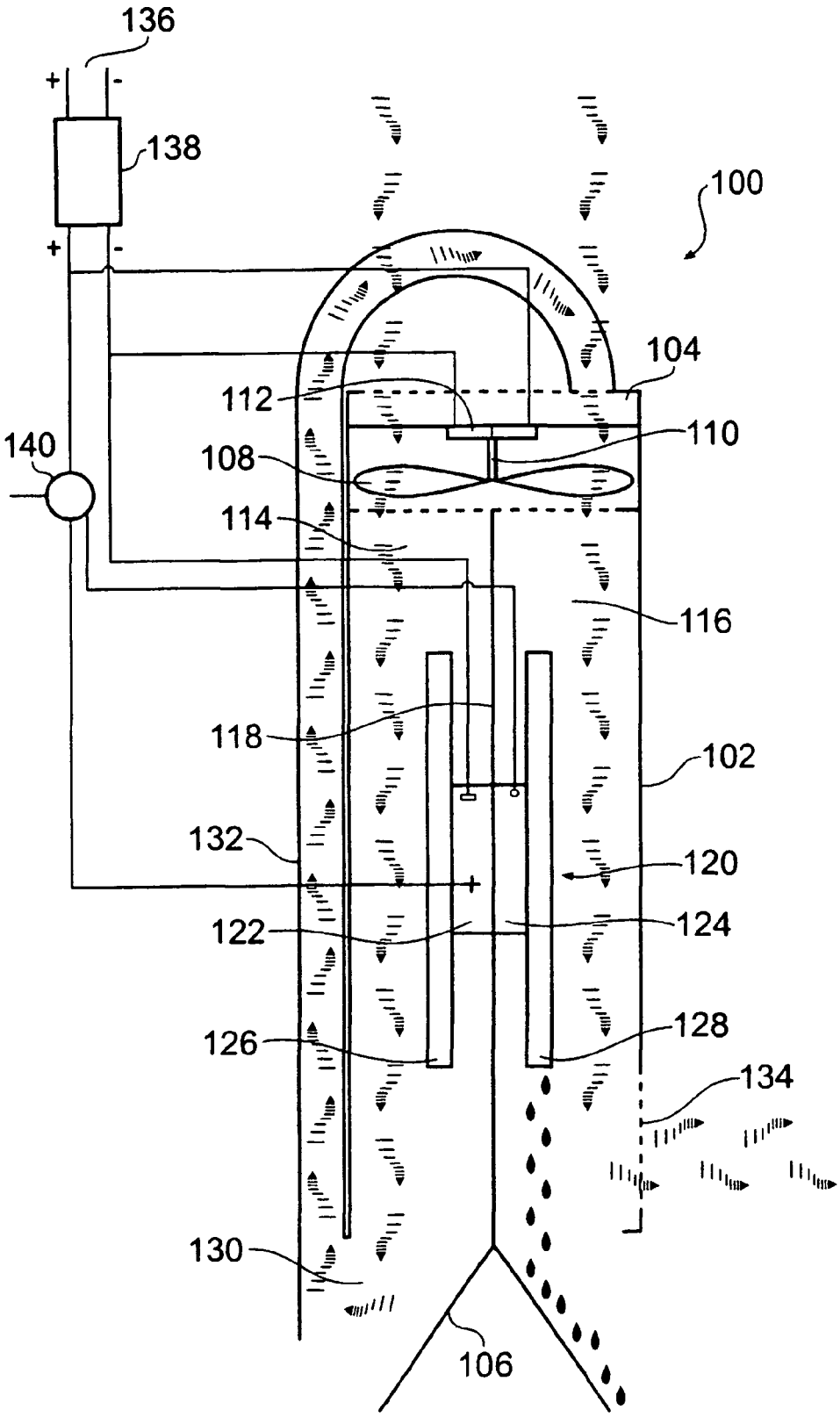
FIG. 7 illustrates a preferred form of dehumidifier for use with the cover of the invention.

In order to reduce the moisture content of the air within the storage enclosure, for example to reduce the occurrence of rusting of a vehicle stored therein, it may be advantageous to include a dehumidifier unit with the cover. FIG. 7 shows a schematic diagram of a preferred form of dehumidifier unit in accordance with the invention. Uniquely, the dehumidifier unit 100 operates using a Peltier Effect principle.

The dehumidifier unit 100 consists of a cylindrical tube 102 defining an outer casing. The tube is open at a first end 104 thereof and closed at a second end 106. A fan 108 is mounted within the tube adjacent the open end 104 for rotation about an axis extending parallel to the central axis of the tube 102. The fan 108 is mounted on a shaft 110 which is coupled to a DC motor 112 for rotating the fan. The fan 108 is arranged to draw air from outside the unit, through the open end 104 and into the tube 102.

The tube 102 is separated into first and second parallel chambers 114,116 by means of a wall 118 which extends fully across the diameter of the tube and from one end of the tube to the other.

A Peltier unit, shown generally at 120 is mounted on the wall 118 at a midpoint along the length of the tube 102. The Peltier unit 120 consists of a first rectangular metal block 122 mounted on one side of the wall 114 in the first chamber 114, and a similarly shaped second metal block 124 mounted in alignment with the first block 122 on the other side of the wall 114 in the second chamber 116. The first and second metal blocks are of different metals and are electrically coupled to each other through the wall. Each metal block 122, 124 has a respective heat sink element 126, 128 thermally connected to it.

At the end of the first chamber 114 remote from the fan is an outlet 130 which is connected to a pipe 132. The pipe 132 extends along the outside of the tube 102 and re-enters the tube at the open end 104 of the second chamber 116. The closed end 106 of the second chamber 116 also has an opening 134, the purpose of which is described below.

Positive and negative terminals of a DC power supply 136 are connected to a hygrometer 138. A positive output from the hygrometer is connected both to a positive terminal of the DC motor 112 which drives the fan 108 and to one terminal of a thermostat control unit 140. A second terminal of the thermostat control unit 140 is connected to the second metal block 124 of the Peltier unit 120. The Peltier unit 120 is also connected to an input of the thermostat control unit. A negative output from the hygrometer 138 is connected both to the negative terminal of the DC motor 112 and to the first metal block 122 of the Peltier unit 120.

In operation, the hygrometer 138, connected to the DC power supply 136 continuously measures the humidity of the air within the storage enclosure defined by the cover 10.

At a predetermined humidity level, the hygrometer 138 switches to connect the dehumidifier unit 100 to the DC power supply 136 thereby to activate the unit.

The current from the DC power supply is fed to the DC motor 112 which drives the fan 108. As the fan rotates, air is drawn from within the storage enclosure, through the open end 104, past the fan and into the tube 102.

Current is also supplied to the Peltier unit 120 which operates in a conventional manner such that the first metal block 122 in the first chamber 114 of the unit begins to absorb heat and become warm and the second metal block 124 in the second chamber 116 begins to give off heat and is cooled.

Air which is forced by the fan 108 along the first chamber 114, past the heated first metal block 122 and heat sink 126, is therefore warmed, while air which is forced down the second chamber 116, past the cold second metal block 124 and heat sink 128 is cooled. As this air is cooled, the water vapour contained therein is condensed and forms water droplets on the cold heat sink 128. This water is then drained from the dehumidifier unit 100 and out of the cover 10. The dehumidified air is then passed through the opening 134 in the closed end 106 of the second chamber 116 to be recirculated back into the storage enclosure.

The heated air in the first chamber 114 is passed through the opening at the closed end 106 and is conveyed along the pipe 132 and flows back into the second chamber 116 at the open end 104 where it is mixed with the air being drawn into the second chamber by the fan 108. This allows the warm air also to be dehumidified and enhances the efficiency of the unit.

Such a dehumidifier unit may easily be incorporated within the cover 10 of the present invention. It may be powered by an external DC supply or alternatively, by an internal battery or the battery of the vehicle stored within the cover. Reducing the moisture content of the air within the cover reduces the likelihood of rust occurring on the vehicle and reduces the degrading effect of water on the vehicle's components.

The use of a DC power supply increases operator safety and enables the apparatus to be exempt from regulations governing the use of AC power.

In order to reduce or prevent moisture-laden air outside the cover 10 from seeping into the enclosure, sealing means may be provided between the first and second cover members 12.

The dehumidifier may be operated such that when the temperature inside the enclosure is in the range of around 1° C. and 12° C. with humidity levels above a predetermine level, as determined by a hygrometer, the dehumidifier is operated. When the temperature rises above said range to, say, above 13° C., the dehumidifier is switched off and, provided that the humidity levels remain a predetermined level, the fan or fans are operated to remove air from the enclosure and hence control the humidity level within the enclosure. If the interior of the enclosure needs to cool without reference to humidity, the fan may be operated.

The invention claimed is:

1. A vehicle cover comprising first and second cover members wherein the second cover member is pivotable by pivot means relative to the first cover member between open and closed positions of the cover, in the open position of which one member lies inside the other member, and a base member on which the first cover member is mounted so that, after the second cover member is pivoted to the open position, the first and second cover members are reciprocally moveable as one relative to the base member to give full access to a vehicle within the cover, wherein the cover further includes biasing means associated with the pivot means for biasing the cover members between said open and closed positions.

2. A vehicle cover according to claim 1 wherein the base member is arranged to be fixed and provide guide means co-operating with the first member to permit said reciprocal movement by way of a rolling action.

3. A vehicle cover according to claim 1 wherein the first and second cover members are of a generally rigid structure and define between them a substantially sealed enclosure when in the closed position.

4. A vehicle cover according to claim 1 wherein the biasing means comprise a lever associated with the pivot means and extending away from the pivot axis, and resilient strut means mounted at one end on the lever at a position displaced from said axis, and at the other end to one of the cover members.

5. A vehicle cover according to claim 4 wherein the lever is rigidly attached to a pivot pin of a pivot means, and extends outwardly therefrom, and the resilient strut means extends between the lever and a pivoted mounting on the first cover member, whereby as the second cover member is pivoted relative to the first member, the resilient strut means assists said movement, the strut means coming under compressive pressure during said movement which is resiliently resisted.

6. A vehicle cover according to claim 5 comprises actuating means whereby relative movement of the first and second cover members is caused, the actuating means being attachable to the lever at a position adjacent the connection of the strut means to said lever.

7. A vehicle cover according to claim 4, wherein the pivot axis is located above the pivot mounting of the strut to the associated cover member and the connection of the strut to the lever is above the pivot axis, said connection moving generally horizontally during said pivoting movement of the first and second cover members to one or other side of a line joining the pivot axis and the location of said mounting.

8. A vehicle cover according to claim 6, wherein said actuating means also effects said reciprocal movement of the first and second cover members after the second member has been pivoted relative to the first member, such movement being biased by gas strut means extending in the direction of travel during the reciprocal movement.

9. A vehicle cover according to claim 6 wherein the actuating means includes a motor imparting linear motion to the first and second cover members.

10. A vehicle cover according to claim 1 comprising dehumidifying means for reducing the moisture content of the air within the closed cover, which dehumidifying means includes a Peltier effect cooler around which the air is passed to remove moisture therefrom.

11. A vehicle cover according to claim 10 wherein the dehumidifier is normally operable when the temperature within the cover is in the range 1° C. to 13° C.

12. A vehicle cover according to claim 1 comprising fan means for exchanging air between the cover and the outside atmosphere.

13. A vehicle cover according to claim 1 comprising sensor means associated with at least one edge of the second cover to sense that the cover is in engagement with a fixed surface when the cover is closed.

* * * * *